US007566012B2

(12) United States Patent
Wang et al.

(10) Patent No.: US 7,566,012 B2
(45) Date of Patent: Jul. 28, 2009

(54) MULTI-FUNCTIONAL SPRINKLING APPARATUS STRUCTURE

(75) Inventors: King Yuan Wang, Changhua Hsien (TW); Shun Nan Lo, Changhua Hsien (TW)

(73) Assignee: Yuan Mei Corp., Changhua Hsien (TW)

( * ) Notice: Subject to any disclaimer, the term of this patent is extended or adjusted under 35 U.S.C. 154(b) by 312 days.

(21) Appl. No.: 11/715,503

(22) Filed: Mar. 8, 2007

(65) Prior Publication Data

US 2008/0217427 A1 Sep. 11, 2008

(51) Int. Cl.
*B05B 3/04* (2006.01)

(52) U.S. Cl. ..... 239/237; 239/222.11; 239/231; 239/240; 239/243; 239/248; 239/249; 239/263; 239/381; 239/391

(58) Field of Classification Search ..... 239/200, 239/201, 222.11, 222.13, 225.1, 231, 232, 239/237, 240, 242, 243, 246–249, 255, 263, 239/381, 391–397, 507, 509, 510, 587.1, 239/587.2, 588
See application file for complete search history.

(56) References Cited

U.S. PATENT DOCUMENTS 7,191,958 B1 * 3/2007 Wang ..... 239/200
7,255,291 B1 * 8/2007 Lo et al. ..... 239/242
7,427,038 B2 * 9/2008 Wang et al. ..... 239/240
7,445,164 B2 * 11/2008 Liaw ..... 239/240
7,451,939 B2 * 11/2008 Huang ..... 239/242
7,458,527 B2 * 12/2008 Lutzki ..... 239/230

* cited by examiner

*Primary Examiner*—Len Tran
*Assistant Examiner*—Jason J Boeckmann
(74) *Attorney, Agent, or Firm*—Senniger Powers LLP

(57) ABSTRACT

A multi-functional sprinkling apparatus structure comprises an outlet mount with support lugs to fix on top of a water motor, and a water-guiding member transversely mounted to assembly holes of the support lugs. The assembly holes have water ducts fluidly connected to water-inlet passages of the water-guiding member. A rotary member with a channel and a water shield with actuation holes are pivotally mounted to the middle section of the water-guiding member. The channel of the rotary member has multiple outlets with spray nozzles attached thereto to generate various sprays, and recesses to engage with a movable elastic element mounted to the water-guiding member. The rotary member can be switched to change the outlet matching to a water-discharge orifice of the water-guiding member for a certain spray. The water shield can be bent to one side to adjust the angle of the water-guiding member and the rotary member for sprinkling.

7 Claims, 20 Drawing Sheets

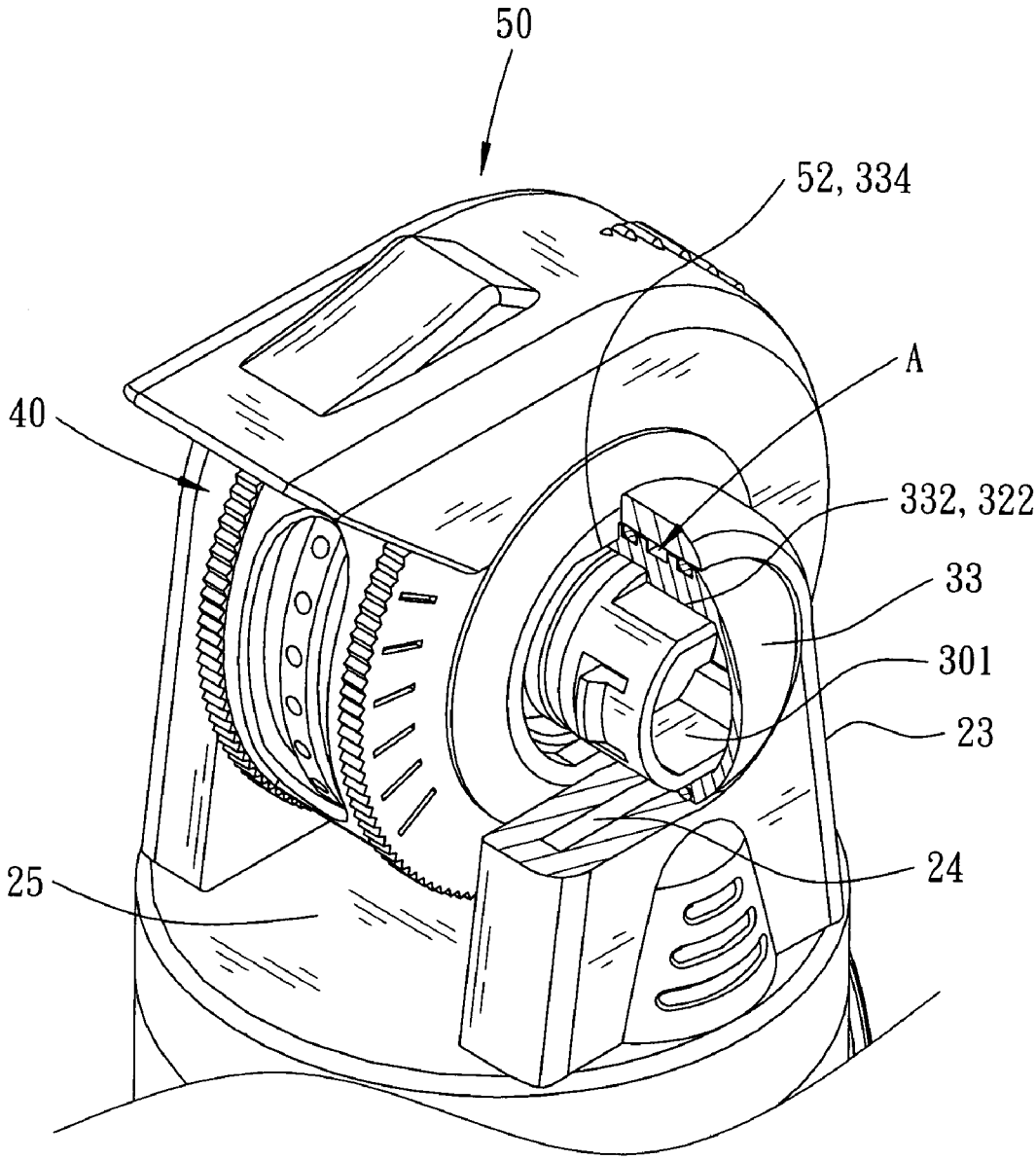
FIG.6-A

MULTI-FUNCTIONAL SPRINKLING APPARATUS STRUCTURE

BACKGROUND OF THE INVENTION

The present invention relates to a multi-functional sprinkling apparatus structure wherein water-inlet passages of a water-guiding member are fluidly connected to water ducts of an outlet mount to form a space respectively and waterproof rings are sealed tight onto assembly holes of the outlet mount for complete and secure transport of water flow, and the water-guiding member is restricted in position by a water shield and equipped with a movable elastic element to flexibly engage with a rotary member; whereby the water shield is simply bent to one side to synchronically actuate the rotation of the water-guiding member and the rotary member therewith and, thus, switch the angle of spray nozzles and outlets of the rotary member as well as a water-discharge orifice of the water-guiding member, providing more flexible and multi-functional application of the present invention.

Conventional vertical-type sprinklers (as shown in the U.S. patents, U.S. Pat. No. D443,674S, U.S. Pat. No. D443,914S, & U.S. Pat. No. D444,848S) are equipped with spray nozzles that are fixed in certain angles, and are unable to switch their angles to fit the locations applied as well as the needs of users. Thus, the conventional sprinklers above are limited in their functions and applications.

SUMMARY OF THE PRESENT INVENTION

It is, therefore, the primary purpose of the present invention to provide a multi-functional sprinkling apparatus structure wherein the water-guiding member has level-surfaced stop faces defining both end sides thereon to be restricted in position by actuation holes of the water shield, and a movable elastic element mounted to the water-guiding member is equipped with an insert block to be flexibly engaged with one recess of the rotary member; therefore, the water shield is simply bent to one side to synchronically actuate the water-guiding member and the rotary member therewith, permitting an enclosure end and a sealing cover of the water-guiding member to rotate around assembly holes of the outlet mount and, thus, switch the angle of spray nozzles attached to outlets of the rotary member as well as a water-discharge orifice of the water-guiding member, providing more flexible and multi-functional application of the present invention.

It is, therefore, the second purpose of the present invention to provide a multi-functional sprinkling apparatus structure wherein water-inlet passages defining both end sides of the water-guiding member are fluidly connected to water ducts of the outlet mount to form a space respectively, and waterproof rings are accommodated to abut tight against the internal surface of the assembly holes thereof for secure and complete transport of water flow; whereby, no matter what angle the water-guiding member is switched to via the water shield, the water flow can smoothly flow into a water-guiding area and go out via the water-discharge orifice and then one outlet of the rotary member to sprinkle outwards via one spray nozzle attached to the outlet thereof.

It is, therefore, the third purpose of the present invention to provide a multi-functional sprinkling apparatus structure wherein the level-surfaced stop faces defining both end sides of the water-guiding member are restricted in position by actuation holes of the water shield so that the water-guiding member can be accurately located in place, and the rotary member can be moved around the water-guiding member to switch the outlet with a certain spray nozzle attached thereto for a change of the water spray. Meanwhile, the movable elastic element has an insert block aligned evenly with the water-discharge orifice and engaged with one of the recesses each juxtaposed in pair with one outlet on a channel of the rotary member. Therefore, no matter what position the rotary member is adjusted to, the insert block of the movable elastic element can precisely couple with one recess of the rotary member for relocation and the water-discharge orifice of the water-guiding element is ensured to fluidly connect to one outlet of the rotary member for water discharge, facilitating easier operation of the sprinkling apparatus thereby.

BRIEF DESCRIPTION OF THE DRAWINGS

FIG. 6-A is a perspective and partially cross sectional view of the present invention.

DETAILED DESCRIPTION OF THE PREFERRED EMBODIMENTS

Figure 1:
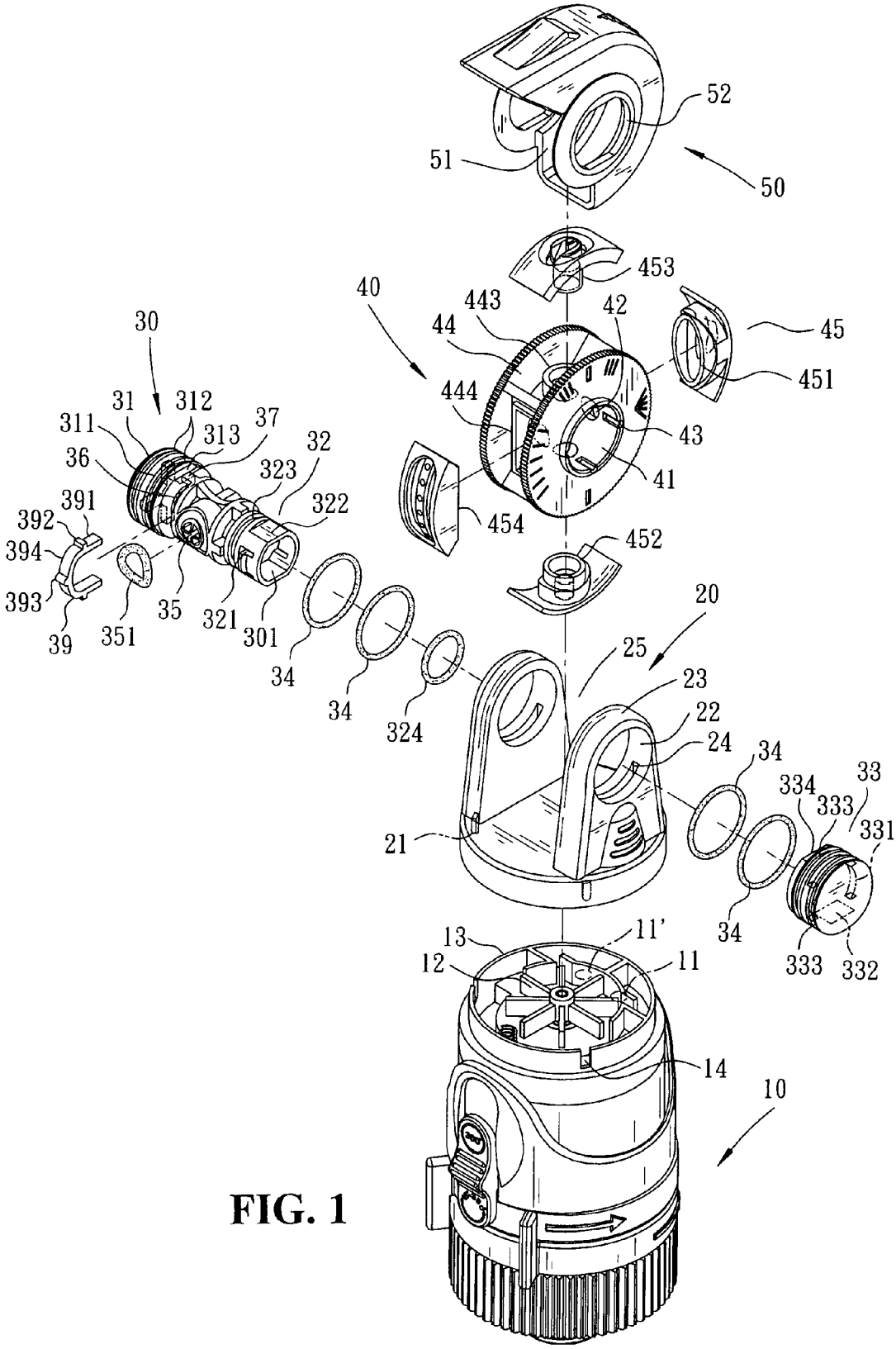
FIG. 1 is an exploded perspective view of the present invention.
Figure 2:
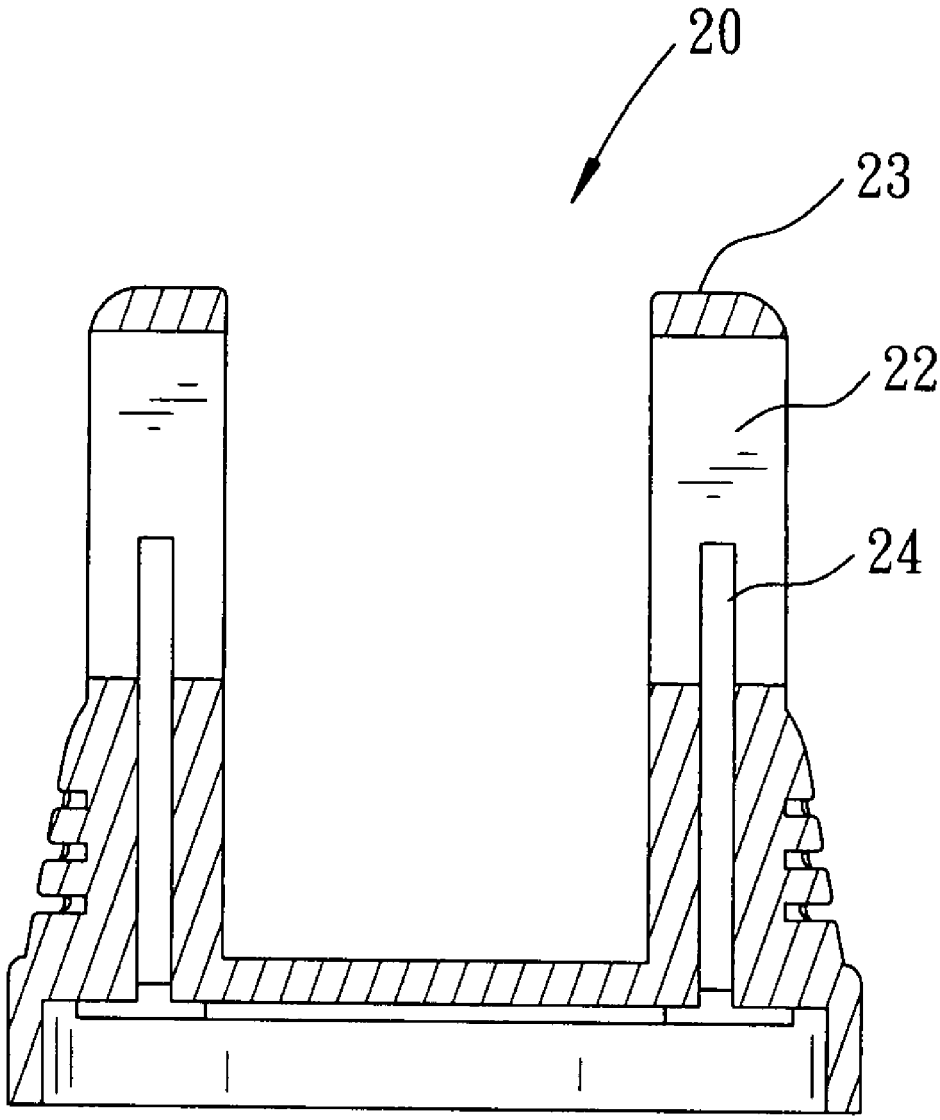
FIG. 2 is a cross sectional view of an outlet mount of the present invention.
Figure 3:
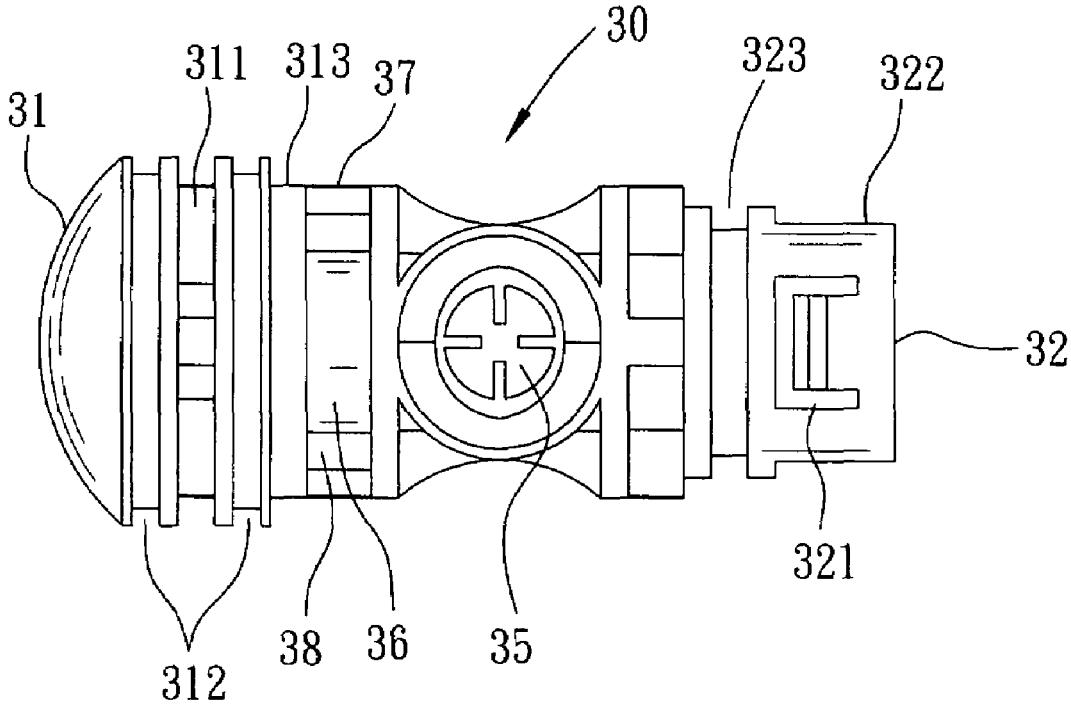
FIG. 3 is a flat view of a water-guiding member of the present invention.
Figure 4:
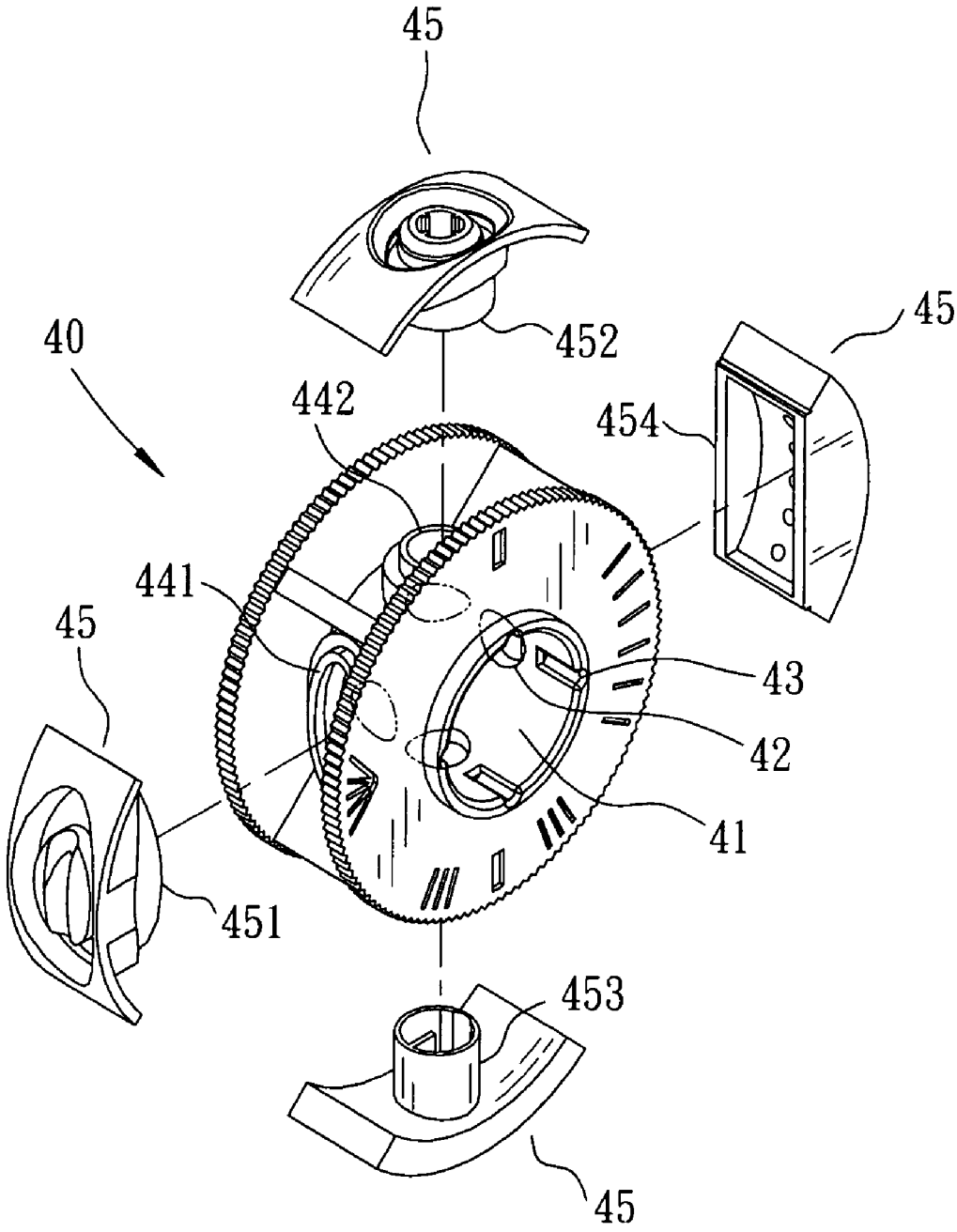
FIG. 4 is an exploded perspective view of a rotary member with spray nozzles of the present invention.
Figure 5:
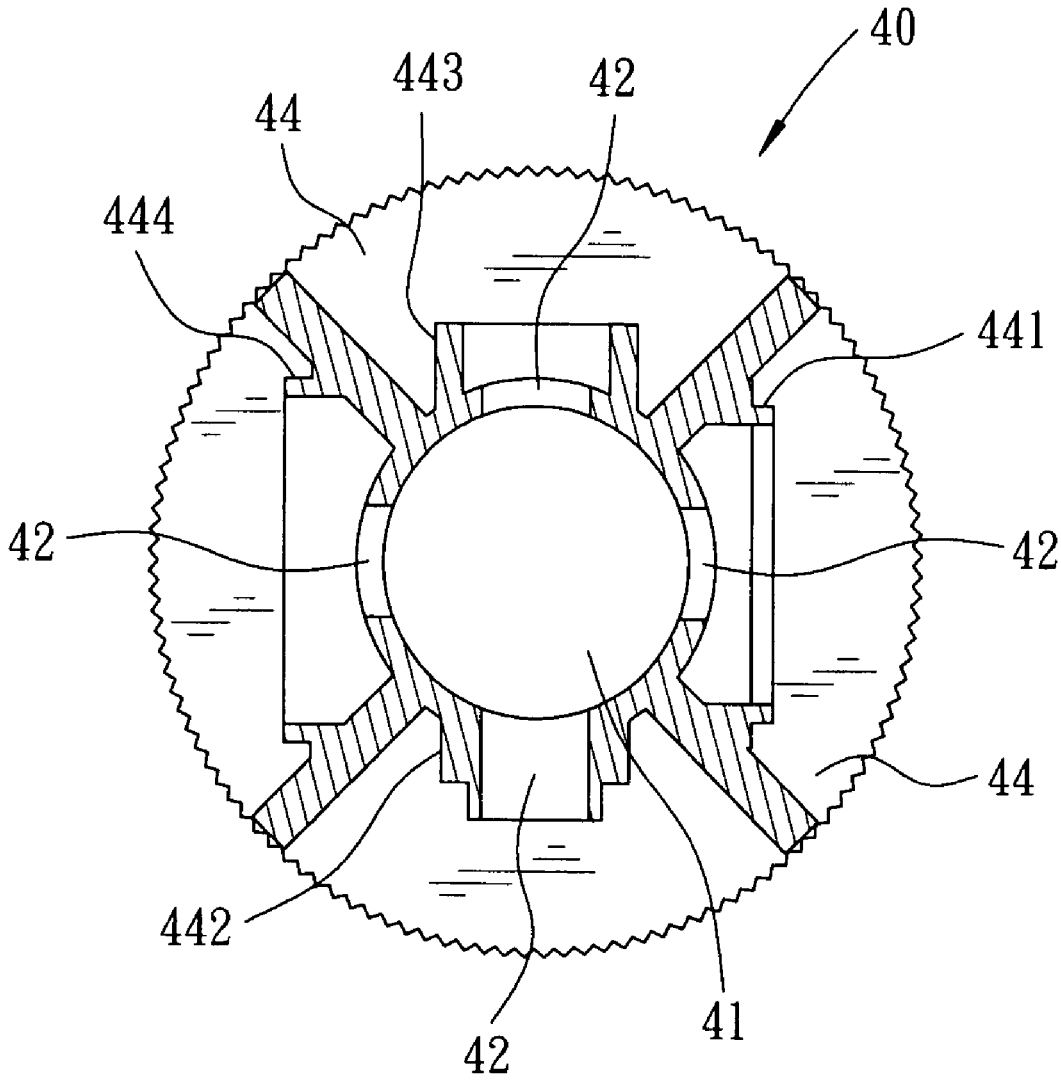
FIG. 5 is a cross sectional view of the rotary member of the present invention.
Figure 6:
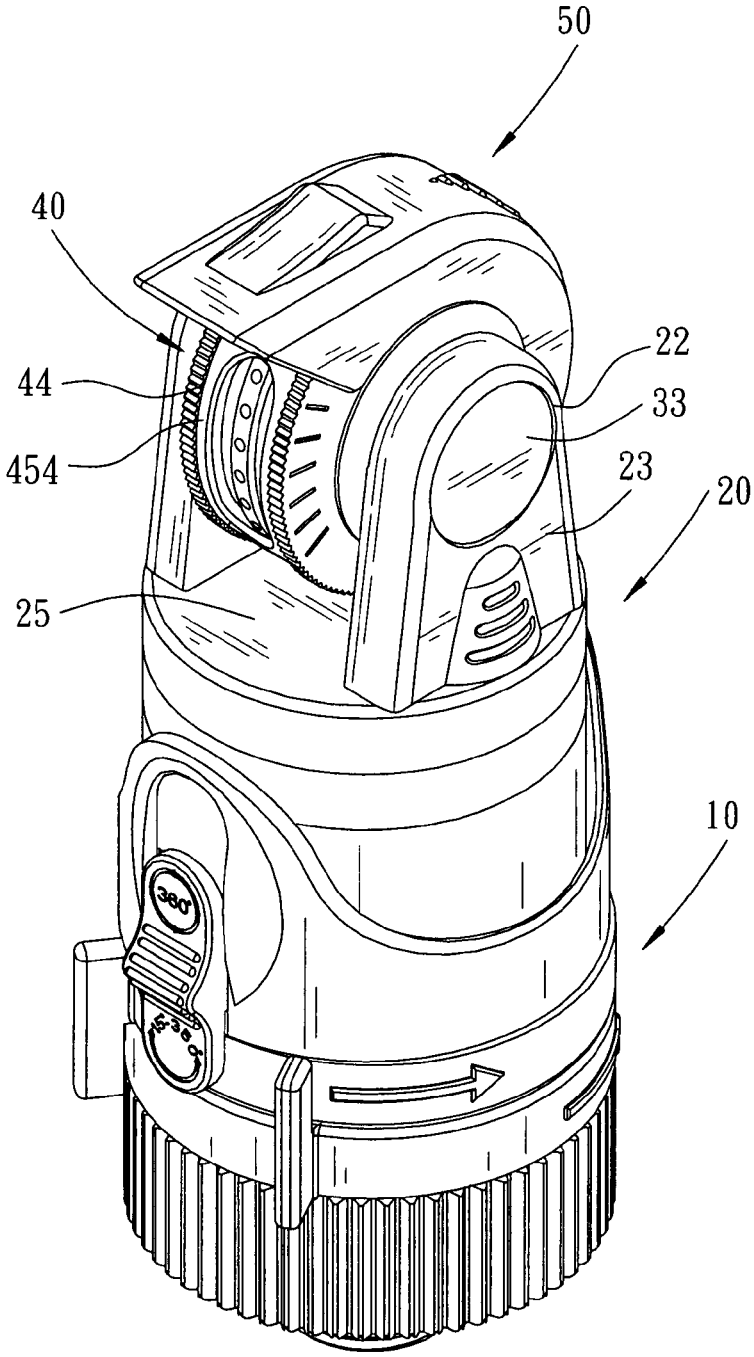
FIG. 6 is an assembled perspective view of the present invention.
Figure 7:
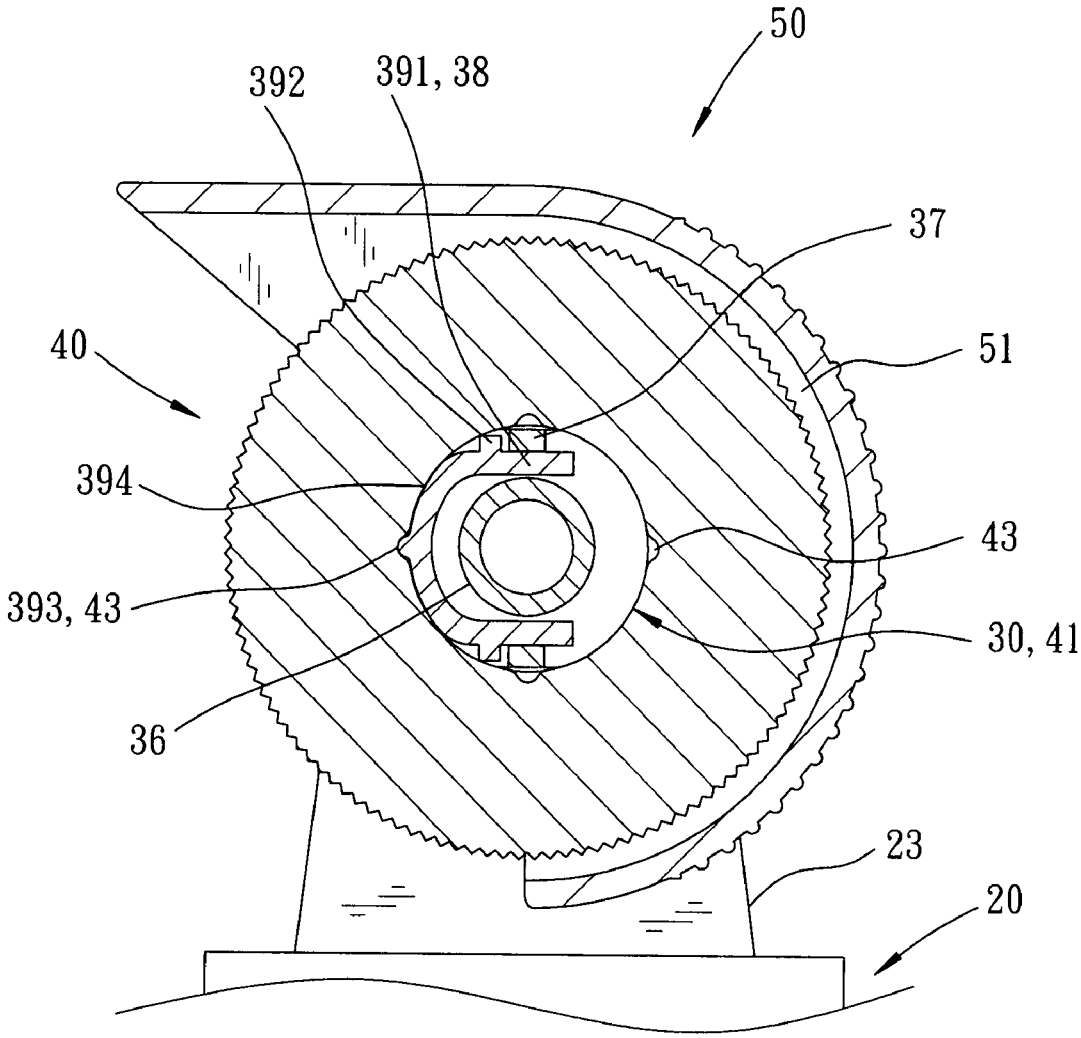
FIG. 7 is a partially cross sectional view of the present invention in assembly.
Figure 8:
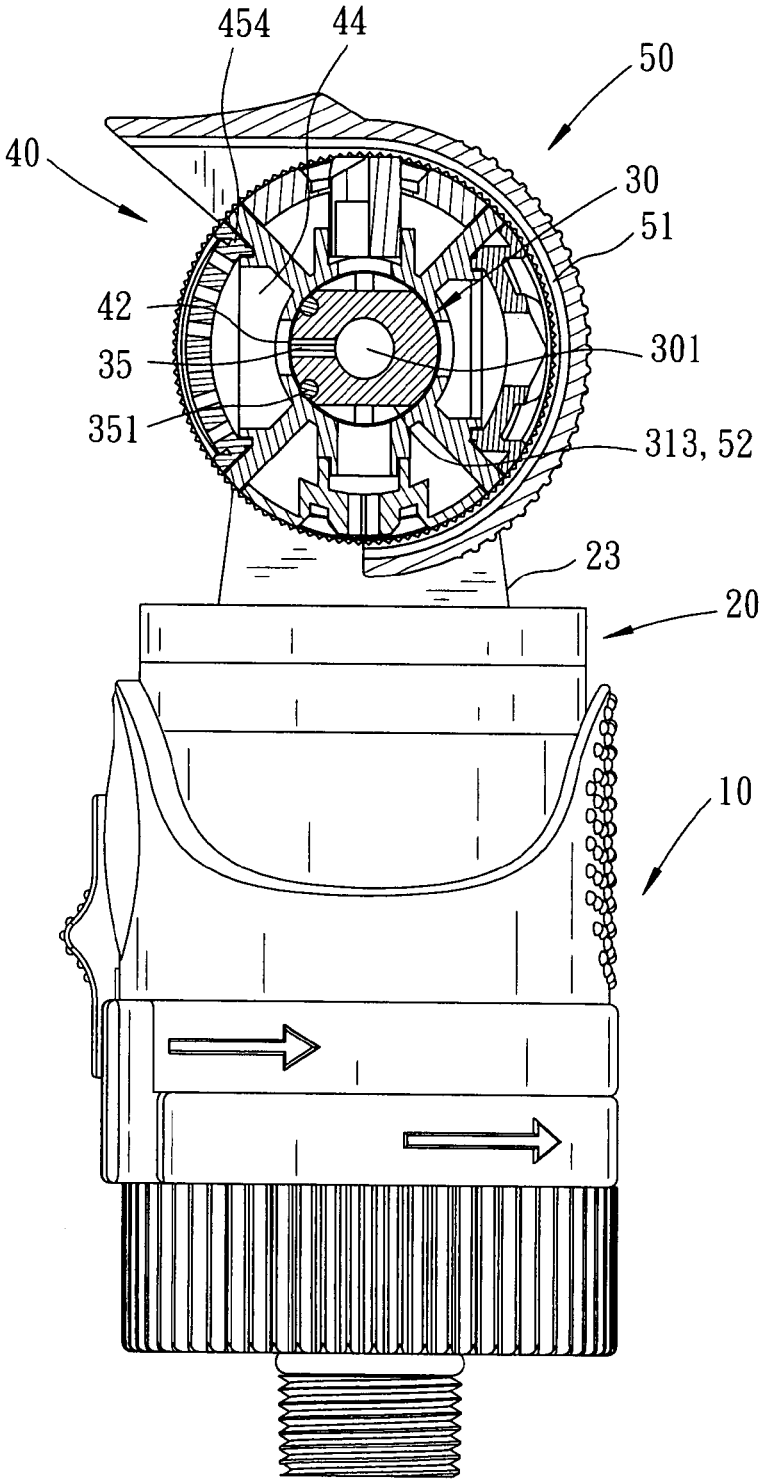
FIG. 8 is an assembled flat and partially cross sectional view of the present invention.
Figure 9:
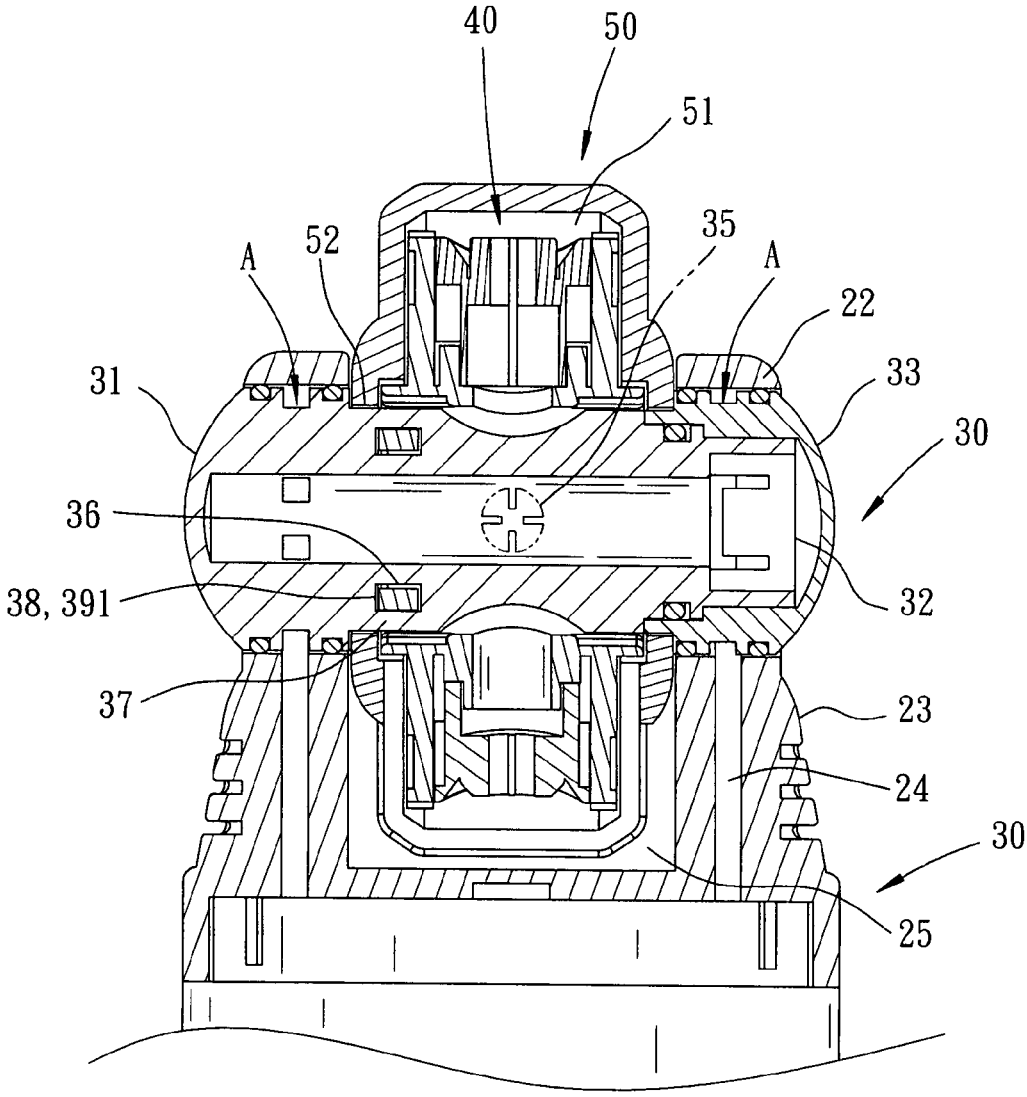
FIG. 9 is another assembled flat and partially cross sectional view of the present invention.

Please refer to FIG. 1 showing an exploded perspective view of the present invention (accompanied by FIGS. 2 to 9 inclusive). The present invention relates to a multi-functional sprinkling apparatus structure, comprising a sprinkler that can swing back and forth in different angles or in 360° one-way rotation wherein the sprinkler includes a water motor 10 equipped with two outlet apertures 11, 11' and an impeller 12, and an outlet mount 20 fixed on top of the water motor 10 thereon. The water motor 10 has a top flange 13 defined by indented cavities 14 to precisely fit to protrusive blocks 21 extending at the internal surface of the outlet mount 20 thereon. The outlet mount 20 has a top surface equipped with a set of symmetrically-arranged support lugs 23 each having an assembly hole 22 disposed thereon so that a water-guiding member 30 can be transversely mounted to locate astride there-between. The support lug 23 is hollow inside with a water duct 24 drilled at the internal bottom arcuate surface of the assembly hole 22 to extend downwards through to the bottom surface and fluidly communicate with one of the two outlet apertures 11, 11' of the water motor 10 respectively. A movement space 25 is formed between the two support lugs 23 to match to a rotary member 40 and a water shield 50 thereby. The water-guiding member 30, hollow inside to form a water-guiding area 301, is equipped at one side with a larger-diameter enclosure end 31 having an arcuate water-inlet passage 311 defining the outer circumferential surface thereon, and the other side a smaller-diameter opening end 32 with an arcuate water-guiding port 321 defining the outer circumferential surface thereon to mount to a sealing cover 33 having another arcuate water-inlet passage 331 cut at the outer circumferential surface thereon. The opening end 32 has the outer side defined by a set of symmetrical flat-surfaced conjoining faces 322 to match to flat-surfaced conjoined faces 332 symmetrically cut at the inner side of the sealing cover 33 and be reciprocally restricted in position thereby. The water-inlet passages 311, 331 of the enclosure end 31 and the sealing cover 33 are respectively defined by a set of annular grooves 312, 333 at both sides thereon each for the accommodation of a waterproof ring 34 therein, permitting the waterproof rings 34 of the enclosure end 31 and the sealing cover 33 to accurately position at both side of the water duct 24 and seal tight and close onto the internal surface of the assembly holes 22 respectively. Thus, the water-inlet passages 311, 331 thereof can be respectively matched to one water duct 24 to form a space A there-between. Furthermore, the water-guiding port 321 has a ringed groove 323 defining one side thereon for the accommodation of a sealing hoop 324 therein so as to abut tight and close against the internal surface of the sealing cover 33 thereby. The water-guiding member 30 has a middle section defined by a water-discharge orifice 35 that, having a water-sealing ring 351 mounted to the outer periphery thereon, is fluidly connected to the water-guiding area 301. Both the enclosure end 31 and the sealing cover 33 are respectively equipped with a set of level-surfaced stop faces 313, 334 symmetrically cut at one side thereon. The water-guiding member 30 also includes a smaller-diameter connecting section 36 extending at one side of the level-surfaced stop faces 313 of the enclosure end 31, and a set of upper and lower stop ribs 37 extending over the connecting section 36 to form a guide opening 38 for the accommodation therein of a U-shaped movable elastic element 39 with a set of guide legs 391 extending thereon. Both guide legs 391 of the movable elastic element 39, each having a stop block 392 protruding thereon, are linked to an arcuate-curved abutment surface 394 equipped with an insert block 393 thereon. The insert block 393 is evenly aligned with the water-discharge orifice 35 thereof. The rotary member 40 is molded in a cylindrical shape having a channel 41 extending through the center thereon. The water shield 50 has an arched pivoting groove 51 disposed at one side for the accommodation of the rotary member 40 therein. The pivoting groove 51 has both lateral sidewalls defined by a set of actuation holes 52 that, each having level-shaped edges symmetrically cut at both sides thereon, are matched to the channel 41 and synchronically guided therewith to mount to the water-guiding member 30 and position in the movement space 25 thereof, permitting the actuation holes 52 to precisely engage with the level-surfaced stop faces 313, 334 thereby. The channel 41 has multiple outlets 42 and recesses 43 annularly arranged at the internal surface thereon to precisely match to the water-discharge orifice 35 and the insert block 393 respectively, permitting the water-sealing ring 351 to seal tight onto the internal surface of the channel 41 thereby. The insert block 393 is flexibly engaged with one recess 43, permitting the water-discharge orifice 35 to fluidly connect to one outlet 42 thereby. The rotary member 40 has the external circumference divided into multiple groove zones 44 each precisely matching to the position of one outlet 42 for the accommodation of one spray nozzle 45 thereto. The groove zones 44 are respectively equipped with an elongated oval protrusive flange 441, a stepwise protrusive flange 442, an annular protrusive flange 443, and a rectangular protrusive flange 444, and the spray nozzles 45 are respectively equipped with an elongated oval coupling hole 451, a rounded stepwise coupling hole 452 with multiple water-blocking ribs extending at the internal surface thereon, an annular coupling hole 453 having an opening and a water-blocking rib disposed at the opposite sides of the internal surface, and a rectangular coupling hole 454 having multiple spray apertures arranged at the internal surface thereon so as to match to the protrusive flanges 441, 442, 443, 444 of the groove zones 44 thereby.

Figure 10:
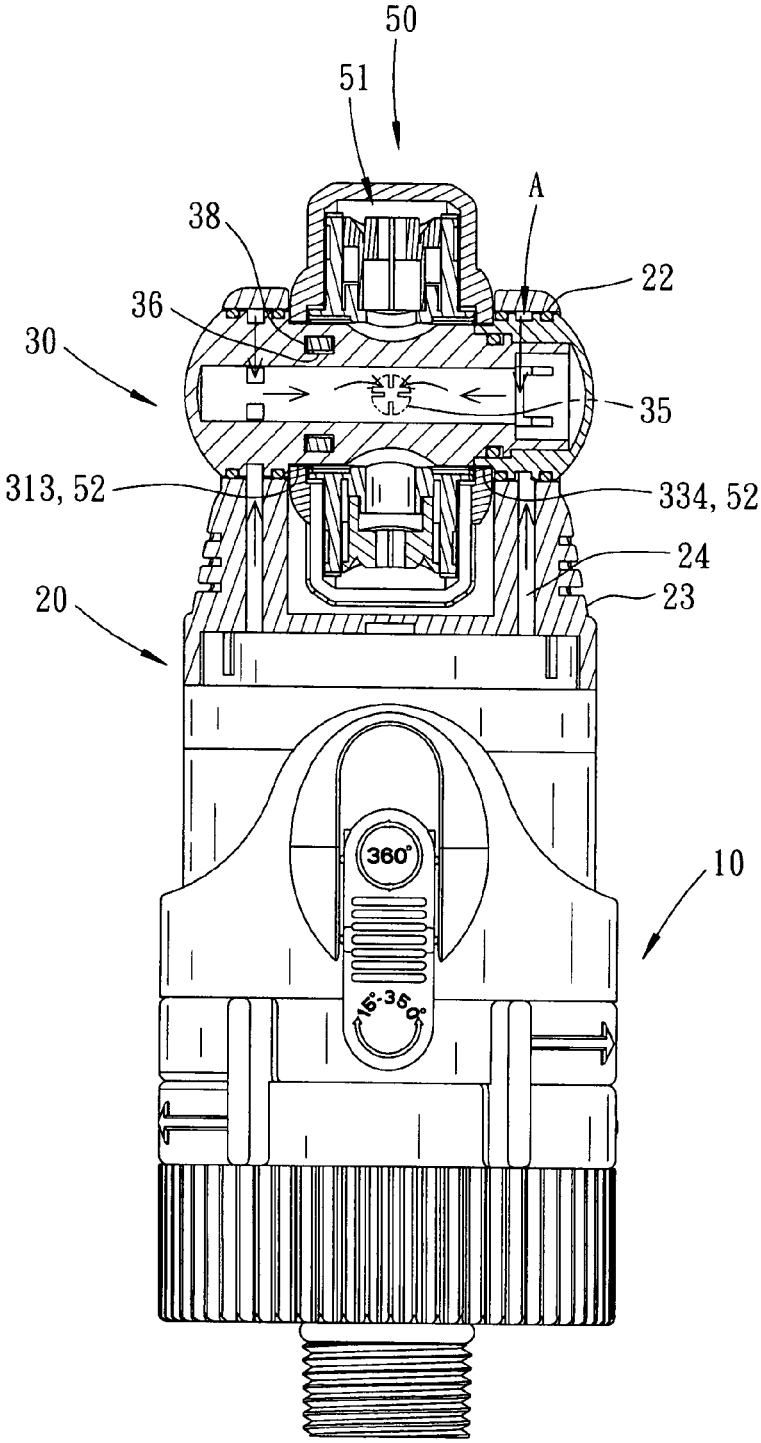
FIG. 10 is a diagram showing water flow transported from the outlet mount to enter the water-guiding member and emit there-from via a water-discharge orifice of the present invention.
Figure 11:
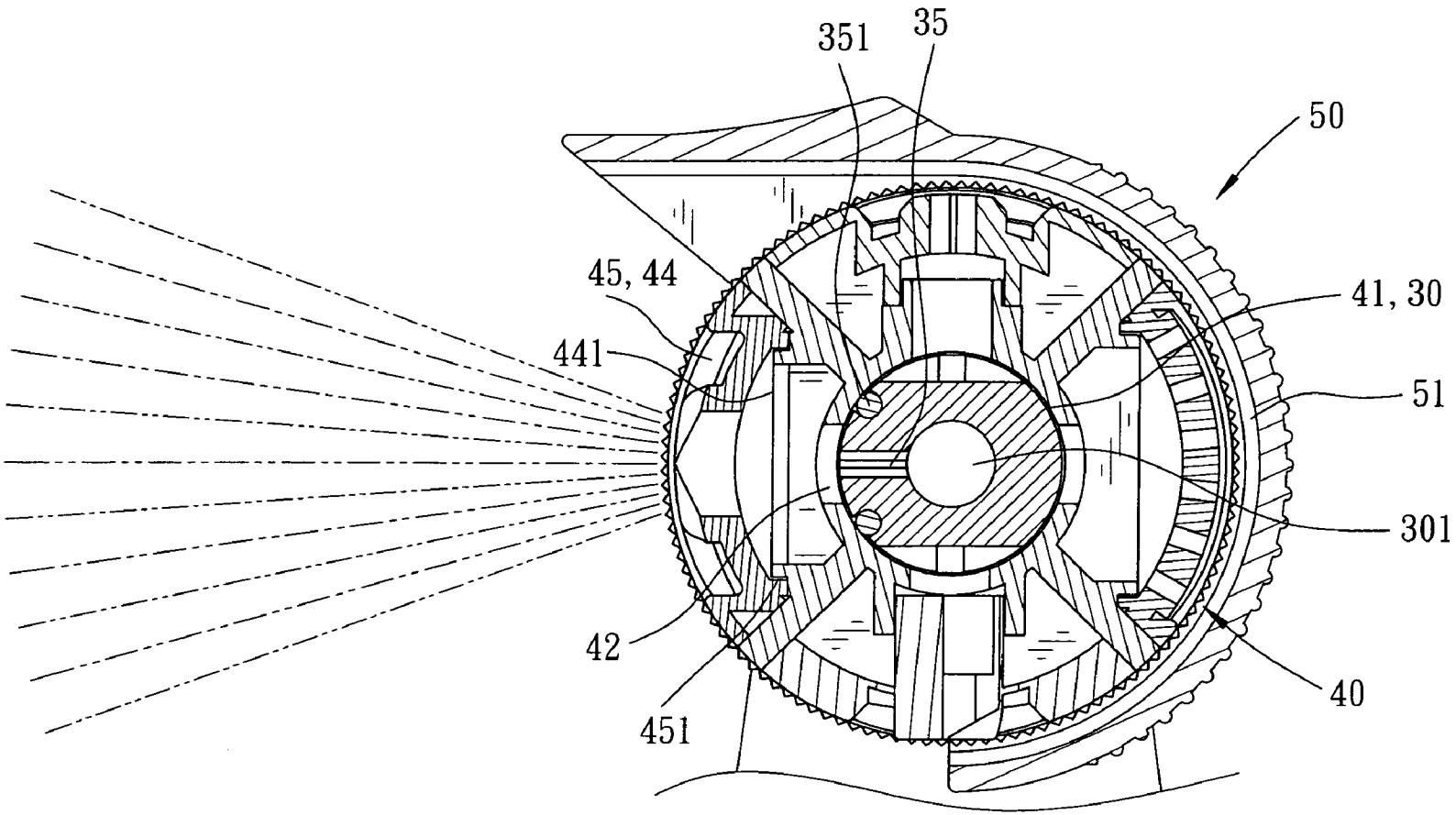
FIG. 11 is a diagram showing the water flow of the present invention sprinkling outwards in an expanding fan-like spray.
Figure 12:
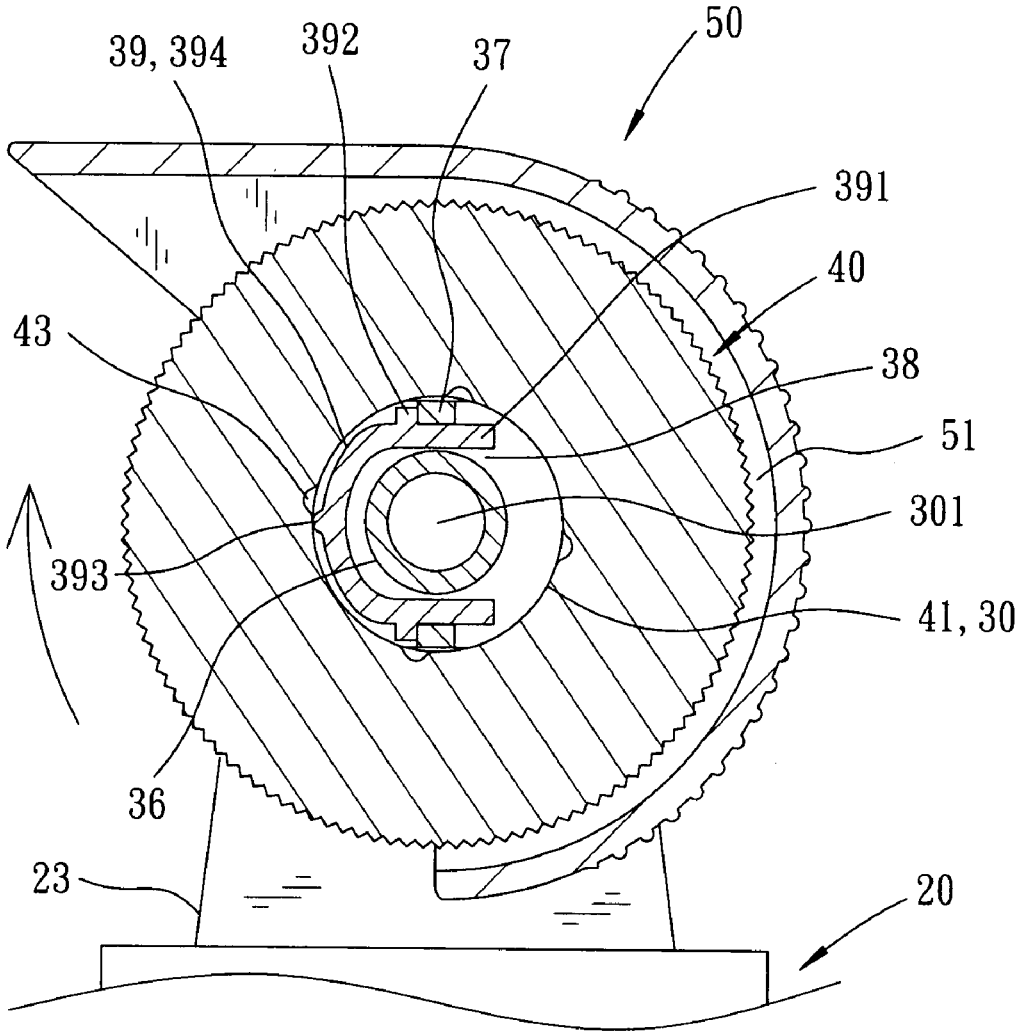
FIG. 12 is a diagram showing the rotary member of the present invention adjusted around the water-guiding member to change a different spray nozzle matching to the water-discharge orifice of the water-guiding member.
Figure 13:
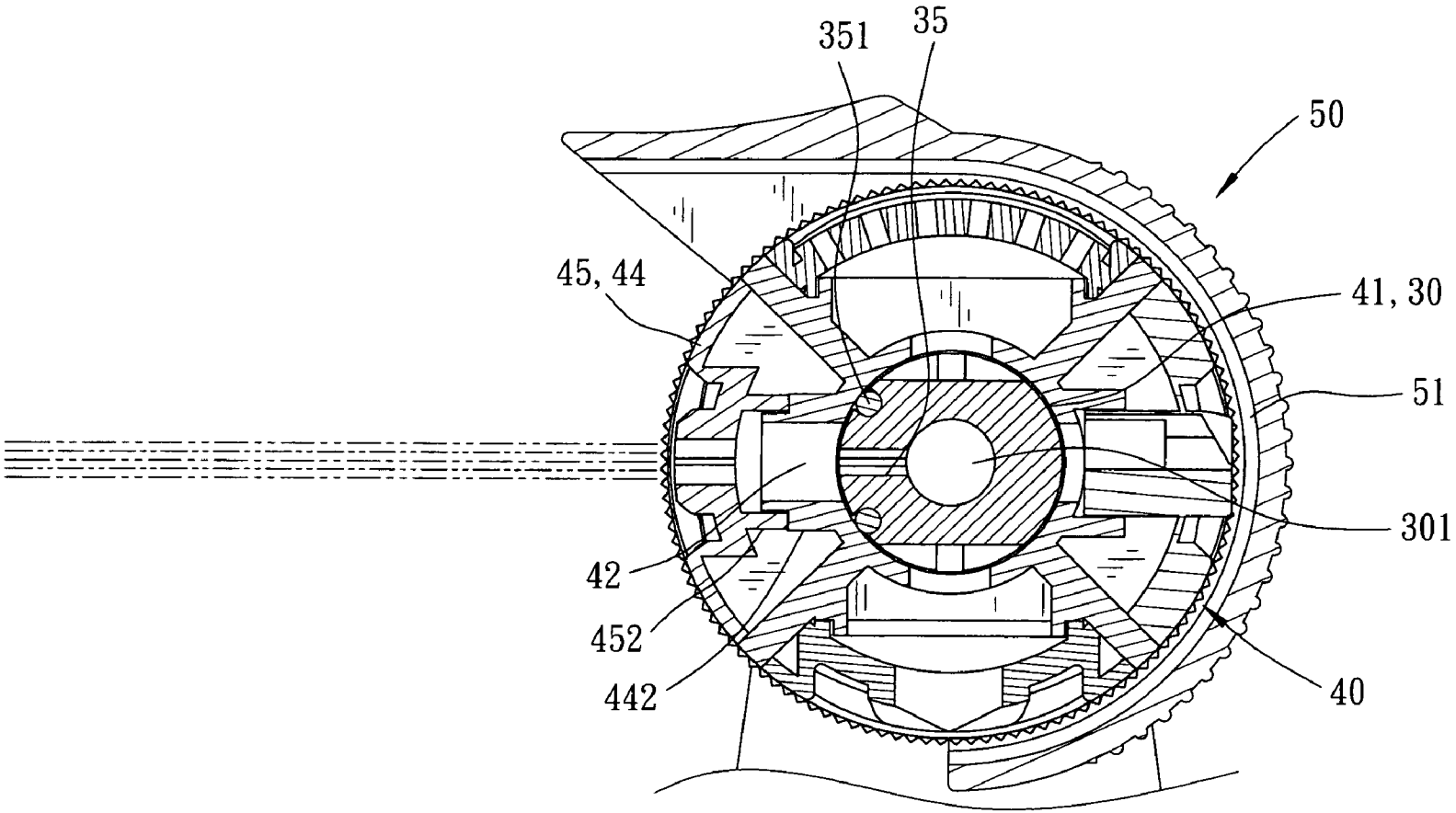
FIG. 13 is a diagram showing the rotary member of the present invention switched to the spray nozzle with the water flow sprinkling outwards in column-like spray
Figure 14:
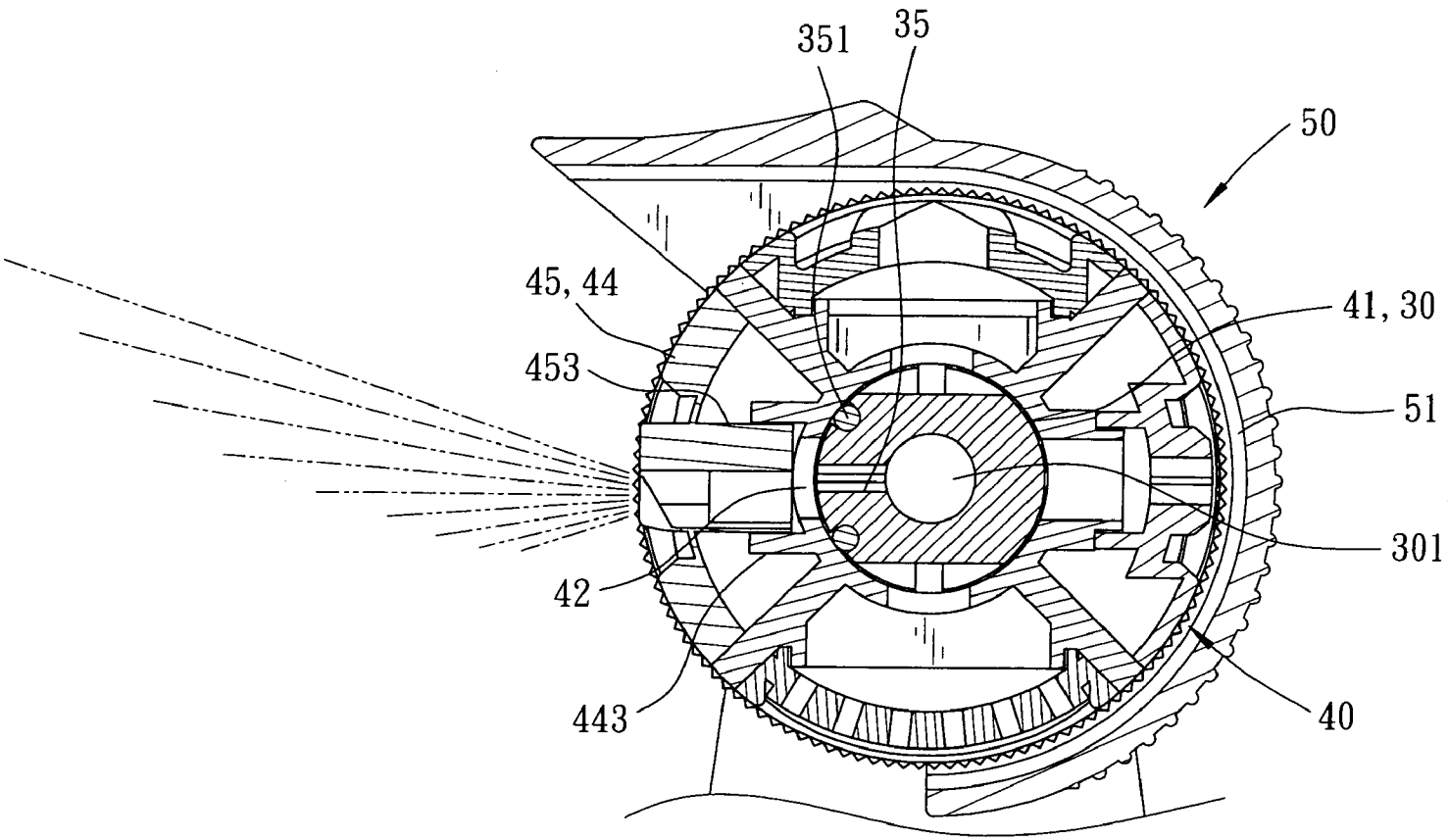
FIG. 14 is a diagram showing the rotary member of the present invention switched to the spray nozzle with the water flow sprinkling outwards from far to near in sequentially expanding spray.
Figure 15:
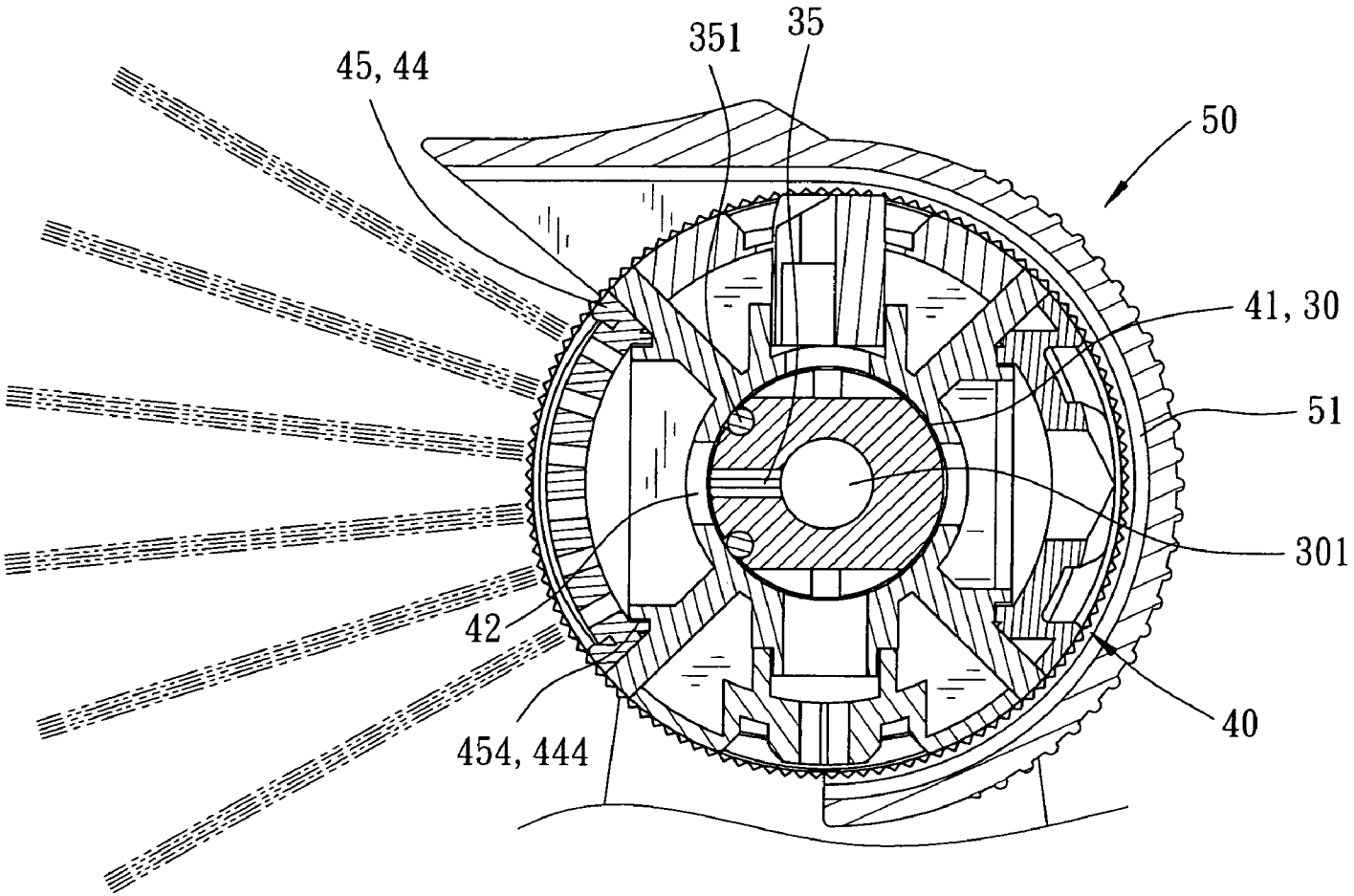
FIG. 15 is a diagram showing the rotary member of the present invention switched to the spray nozzle with the water flow distributing outwards via multiple spray apertures.
Figure 16:
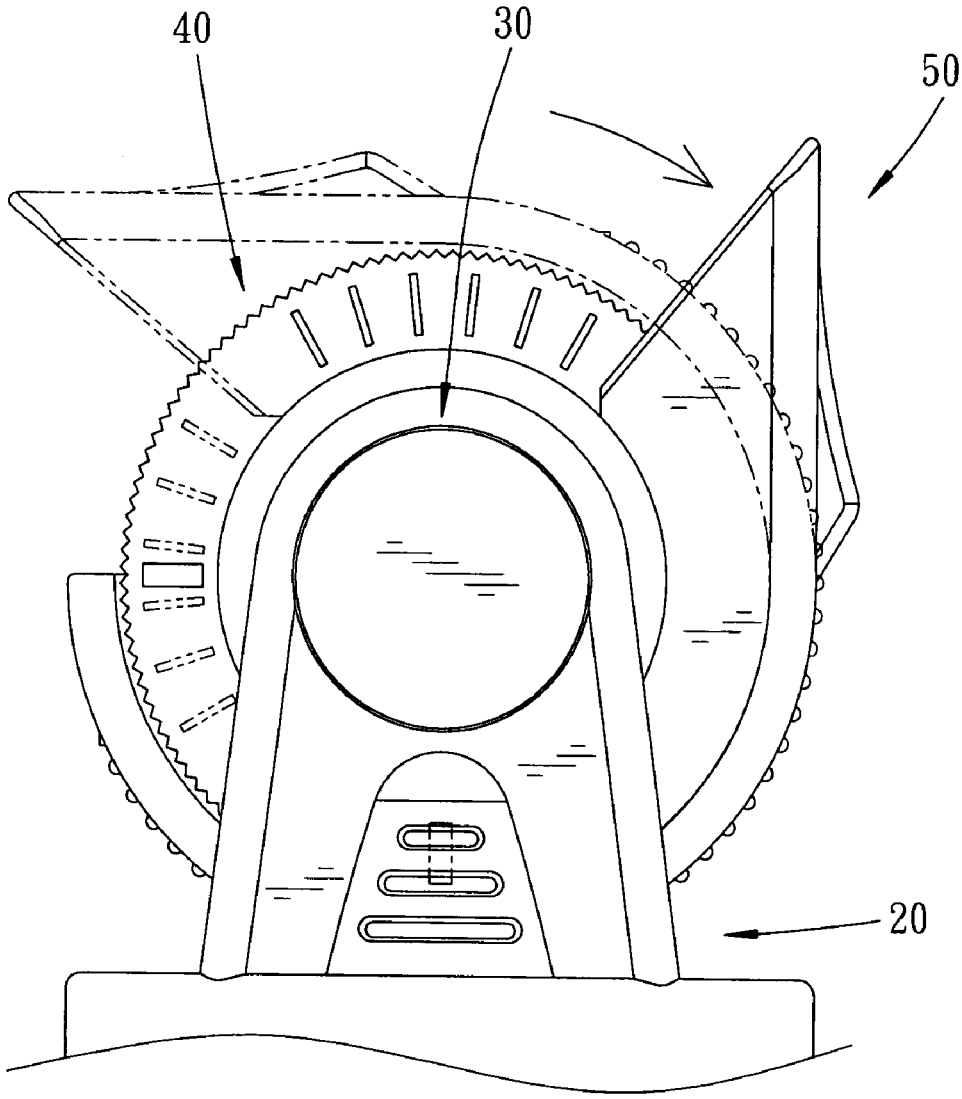
FIG. 16 is a diagram showing the adjustment of a water shield of the present invention.
Figure 17:
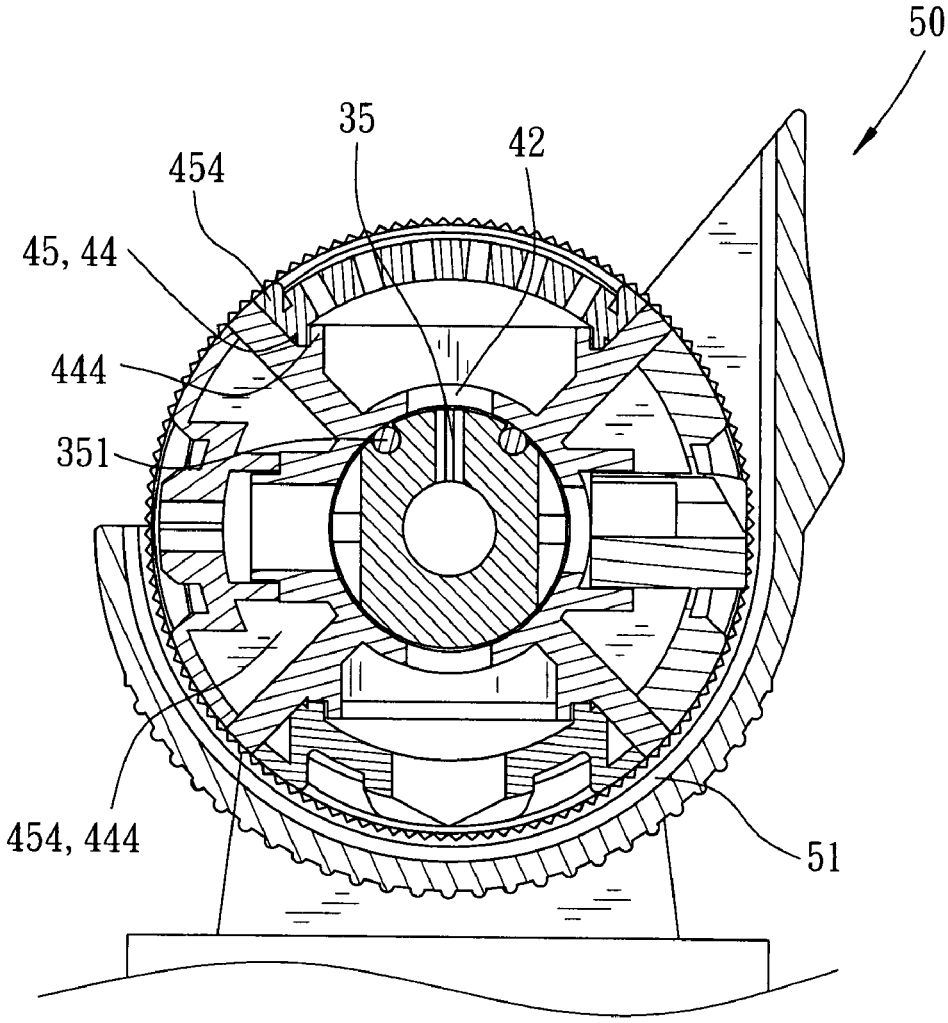
FIG. 17 is a diagram showing the water-guiding member and the rotary member synchronically actuated to rotate along with the movement of the water shield as shown in FIG. 16.
Figure 18:
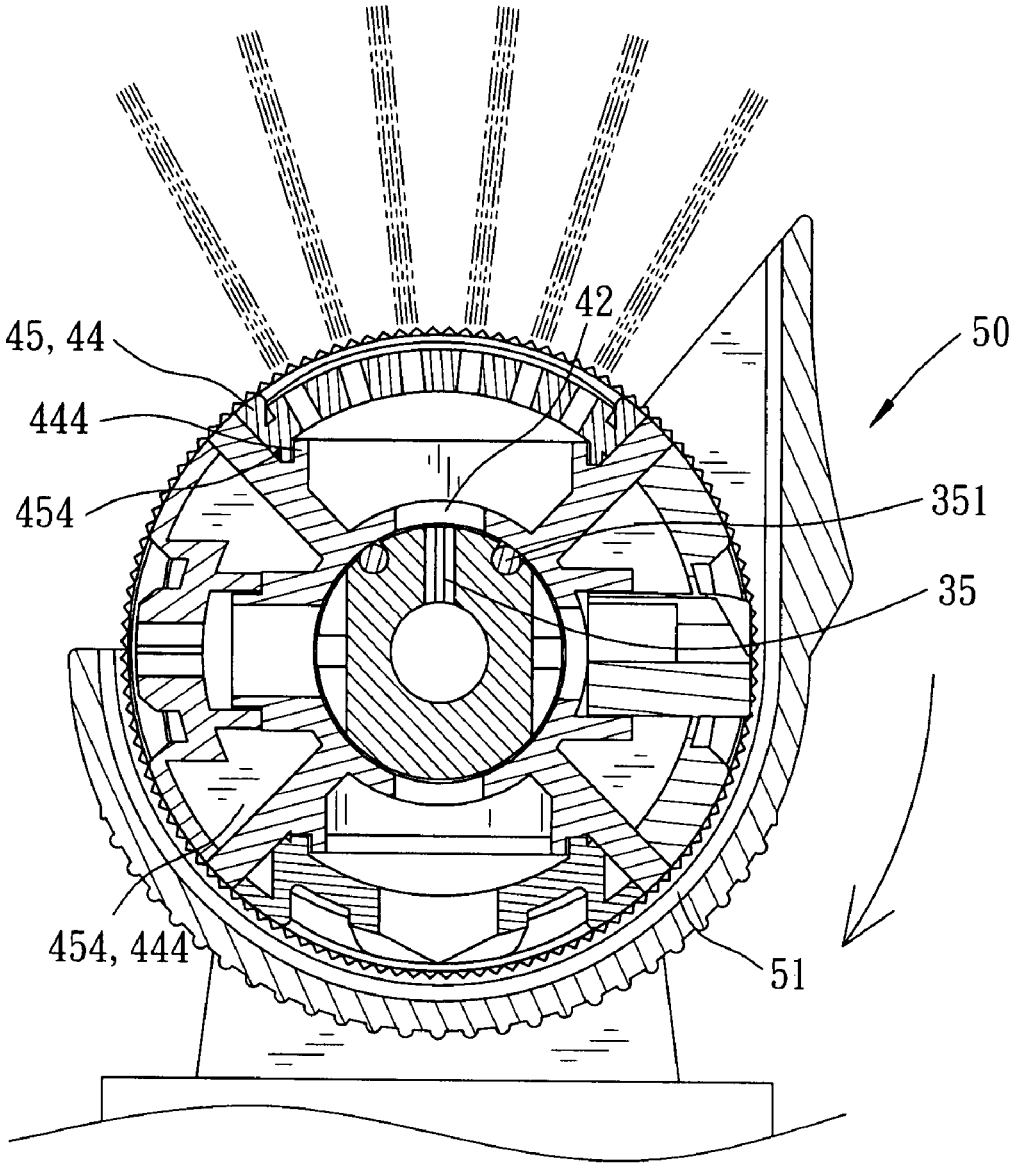
FIG. 18 is a diagram showing the state of water discharge of the present invention as shown in FIG. 17.
Figure 19:
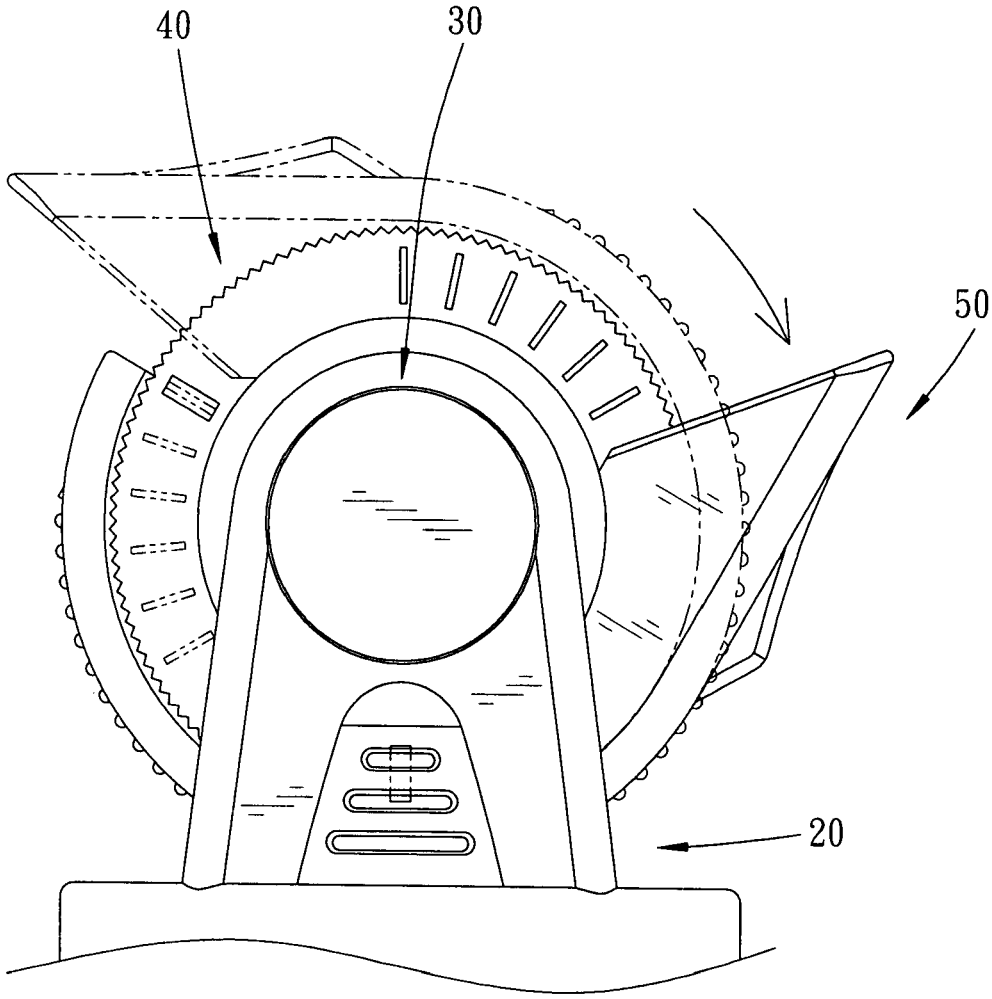
FIG. 19 is another diagram showing the adjustment of the water shield of the present invention.

Please refer to FIG. 10. When water flow transported outwards from either one of the outlet apertures 11, 11' actuates the impeller 12, the outlet mount 20 will move with the water motor 10 and swing back and forth or in 360° one-way rotation. The water flow running through the water ducts 24 of the support lugs 23 extending at both sides of the outlet mount 20 will move along the space A respectively and flow through the water-inlet passages 311, 331 of the enclosure end 31 and the sealing cover 33 and the water-guiding port 321 of the opening end 32 disposed at both sides of the water-guiding member 30 to enter the water-guiding area 301 thereof. Then, the water flow collected in the water-guiding area 301 will run through the water-discharge orifice 35 to emit outwards via one outlet 42 of the rotary member 40. When the spray nozzle 45 mounted to the groove zone 44 of the outlet 42 is equipped with the elongated oval coupling hole 451, the water flow hindered by the elongated oval shape of the coupling hole 451 thereof will be sprinkled outwards in an expanding fan-like spray distribution as shown in FIG. 11. For a change of different water sprays, the level-surfaced stop faces 313, 334 disposed at both ends of the water-guiding member 30 are utilized to engage with the actuation holes 52 of the water shield 50 and restricted in position thereby. The channel 41 of the rotary member 40 is allowed to move around the water-guiding member 30 and rotate within the pivoting groove 51 to adjust the position thereby. When the rotary member 40 is rotated (referring to FIG. 12), the insert block 393 of the movable elastic element 39 will detach from the recess 43 and become pressed by the internal surface of the channel 41, permitting the guide legs 391 to slide along the guide opening 38 till the stop blocks 392 abutting against the stop ribs 37 respectively. When the next recess 43 approaches the insert block 393 and matches thereto, the insert block 393 of the movable elastic element 39 will flexibly bounce to engage with the recess 43 again so as to position the rotary member 40 thereby. Thus, the rotary member 40 can be freely switched to change the outlet 42 matching to the water-discharge orifice 35 of the water-guiding member 30. When the rotary member 40 is switched to the groove zone 44 to which the spray nozzle 45, having a rounded stepwise coupling hole 452 with multiple water-blocking ribs extending at the internal surface thereon, is attached, the water flow stopped by the water-blocking ribs thereof will be collectively concentrated to eject straight outwards in a column-like spray as shown in FIG. 13. When the spray nozzle 45 mounted to the groove zone 44 is provided with the annular coupling hole 453 having an opening and a water-blocking rib disposed at the opposite sides of the internal surface thereon, and is fluidly connected to the water-discharge orifice 35 thereof, the water flow stopped at one side by the water-blocking rib while flowing without any barrier through the opening at the other side will be discharged in mixed strong and weak current to sprinkle from far to near in sequentially expanding spray as shown in FIG. 14. When the spray nozzle 45 mounted to the groove zone 44 is provided with the rectangular coupling hole 454 having multiple spay apertures distributed thereon, and is fluidly connected to the water-discharge orifice 35 thereof, the water flow will be collected to sprinkle outwards via the spray apertures respectively as shown in FIG. 15. Besides, the level-surfaced stop faces 313, 334 disposed at both end sides of the water-guiding member 30 are respectively engaged with the actuation holes 52 of the water shield 50, and the insert block 393 of the movable elastic element 39 is flexibly hooked to one recess 43 of the rotary member 40. Therefore, the water shield 50 (referring to FIGS. 16 to 19 inclusive) can be simply bent towards one side to synchronically actuate the water-guiding member 30 and the rotary member 40 therewith, permitting the enclosure end 31 and the sealing cover 33 of the water-guiding member 30 to rotate around the assembly hole 22 accordingly. Then, the spray nozzles 45 and the outlets 42 of the rotary member 40 as well as the water-discharge orifice 35 of the water-guiding member 30 can be easily switched into any angles, providing more flexible and multi-functional application of the sprinkling apparatus thereby.

What is claimed is:

1. A multi-functional sprinkling apparatus structure, comprising a water motor with an outlet mount fixed to the upper end thereon wherein the outlet mount is equipped with a set of support lugs each having an assembly hole disposed thereon so that a water-guiding member defined by a water-guiding area therein can be transversely mounted to locate astride there-between; furthermore, the assembly holes and the water-guiding member are respectively equipped with water ducts and water-inlet passages that are fluidly connected to each other, and waterproof rings are adapted to both sides of each water-inlet passage of the water-guiding member to securely abut tight against the internal surface of the assembly hole, permitting water flow transported from the water motor to go through the water ducts and the water-inlet passages in a sequence and then enter the water-guiding area of the water-guiding member thereby; to the middle section of the water-guiding member are pivotally mounted a rotary member equipped with a channel and a water shield equipped with actuation holes to synchronically actuate the movement of the water-guiding member thereby; the water-guiding member also includes a water-discharging orifice that is fluidly connected to the water-guiding area and has a water-sealing ring mounted thereto to abut tight and close against the internal surface of the channel of the rotary member thereby; the channel of the rotary member has multiple outlets annularly distributed at the internal surface thereon, and spray nozzles capable of producing various sprays are provided each correspondingly mounted to the outer surface of one outlet thereof; the channel of the rotary member also includes multiple recesses annularly cut at the internal surface thereon, and the water-guiding member has a movable elastic element mounted to one side wherein, depending on the adjustment of the rotary member, the movable elastic element can be actuated and flexibly engaged with one recess to locate the rotary member; therefore, the rotary member can be easily switched to change the outlet matching to the water-discharge orifice of the water-guiding member, and the water flow collected in the water-guiding area and transported through the water-discharge orifice can go through the outlet to sprinkle outwards via the spray nozzle attached to the outlet so as to generate a certain spray thereby; furthermore, the water shield can be simply bent to one side to synchronically actuate the rotation of the water-guiding member and the rotary member therewith and switch the angle of the spray nozzles as well as the water-discharge orifice of the water-guiding member and the outlets of the rotary member thereof; thus, the sprinkling apparatus of the present invention can be freely adjusted in the angles of water discharge to fit to the requirement of locations, achieving flexible and multi-functional application thereby.

2. The multi-functional sprinkling apparatus structure as claimed in claim 1 wherein the water-discharge orifice of the water-guiding member and the insert block of the movable elastic element are set to evenly align with each other, and the outlets and the recesses of the rotary member thereof are also matched in pairs to juxtapose to each other; therefore, when the rotary member is adjusted to any one position, the outlets and the recesses thereof will be synchronically actuated therewith till one outlet is matched to the water-discharge orifice and one recess flexibly engaged with the movable elastic element for location thereby.

3. The multi-functional sprinkling apparatus structure as claimed in claim 1 wherein the water-guiding member has one side equipped with a larger-diameter enclosure end, and the other side having a smaller-diameter opening end with an arcuate water-guiding port defining thereon to which a sealing cover is mounted; the water-guiding member also includes a set of water-inlet passages respectively disposed at the enclosure end and the sealing cover thereon and each having a set of annular grooves defining both sides thereon for the accommodation of a waterproof ring therein respectively; the water-guiding port has a ringed groove defining one side thereon for the accommodation of a sealing hoop therein so as to abut tight and close against the internal surface of the sealing cover thereby; furthermore, both the enclosure end and the sealing cover are respectively equipped with a set of level-surfaced stop faces symmetrically cut at one side thereon to match to actuation holes of the water shield and precisely engage therewith; the actuation hole of the water shield has both sides symmetrically cut into a level-surfaced shape thereof.

4. The multi-functional sprinkling apparatus structure as claimed in claim 3 wherein the opening end of the water-guiding member has the outer side defined by a set of symmetrical flat-surfaced conjoining faces to match to flat-surfaced conjoined faces symmetrically cut at the inner side of the sealing cover, which are reciprocally engaged with each other and restricted in position thereby.

5. The multi-functional sprinkling apparatus structure as claimed in claim 1 wherein the water-guiding member also includes a smaller-diameter connecting section extending at one side thereon and a set of upper and lower stop ribs extending over the connecting section to form a guide opening for the accommodation therein of the movable elastic element with a set of guide legs extending thereon; both guide legs, each having a stop block protruding thereon, are linked to an arcuate-curved abutment surface with an insert block protruding thereon.

6. The multi-functional sprinkling apparatus structure as claimed in claim 1 wherein the rotary member has the external circumference divided into multiple groove zones each precisely matching to the position of one outlet for the accommodation of one spray nozzle, and the groove zones are respectively equipped with an elongated oval protrusive flange, a stepwise protrusive flange, an annular protrusive flange, and a rectangular protrusive flange, etc. and, to match to the various protrusive flanges of the groove zones thereof, the spray nozzles are respectively equipped with an elongated oval coupling hole, a rounded stepwise coupling hole with multiple water-blocking ribs extending at the internal surface thereon, an annular coupling hole having an opening and a water-blocking rib disposed at the opposite sides of the internal surface, and a rectangular coupling hole having multiple spray apertures distributed at the internal surface thereon, etc.

7. The multi-functional sprinkling apparatus structure as claimed in claim 1 wherein the water motor has a top flange defined by indented cavities thereon to precisely fit to protrusive blocks extending at the internal surface of the outlet mount for secure engagement therewith.

* * * * *